US006402117B1

(12) United States Patent
Tsai

(10) Patent No.: US 6,402,117 B1
(45) Date of Patent: Jun. 11, 2002

(54) DISPLAY FRAME FIXING DEVICE

(76) Inventor: Jui-Yi Tsai, P.O. Box 90, Tainan City (TW)

( * ) Notice: Subject to any disclaimer, the term of this patent is extended or adjusted under 35 U.S.C. 154(b) by 0 days.

(21) Appl. No.: 09/897,021

(22) Filed: Jul. 3, 2001

(51) Int. Cl.[7] ..... F16M 13/00
(52) U.S. Cl. ..... 248/530
(58) Field of Search ..... 248/530, 533, 248/156, 222.12, 222.13, 222.51, 230.2, 518

(56) References Cited

U.S. PATENT DOCUMENTS 1,736,177 A * 11/1929 Snook ..... 248/530
4,850,564 A * 7/1989 Padin ..... 248/533
4,858,876 A * 8/1989 Moreno ..... 248/545
5,207,175 A * 5/1993 Andonian ..... 116/209
5,303,931 A * 4/1994 Brown ..... 273/348
5,697,190 A * 12/1997 Scribner ..... 52/165
5,809,700 A * 9/1998 Roush et al. ..... 52/4
6,234,444 B1 * 5/2001 Haddad ..... 248/545
6,308,468 B1 * 10/2001 Caruso ..... 52/165
6,308,927 B1 * 10/2001 Leahy ..... 248/548
6,328,046 B2 * 12/2001 Doreste ..... 135/15.1
6,328,273 B1 * 12/2001 Kemikem ..... 248/530
6,347,600 B1 * 2/2002 Duff, II ..... 116/209

* cited by examiner

*Primary Examiner*—Leslie A. Braun
*Assistant Examiner*—A. Joseph Wujciak, III

(57) ABSTRACT

A display-frame fixing device includes a threaded rod, a base, a fixing cylinder, an elongate cylinder and a sleeve. The threaded rod is embedded in the ground with an upper end exposing out and engages with the base resting on the ground. The fixing cylinder fits around the base, letting two insert blocks fitting with an insert member of the base. The sleeve is rotated to move down to surround the fixing cylinder to push in the insert blocks, which contact with the insert member. Then the fixing cylinder, the elongate cylinder and the sleeve are combined stably with the base on the ground for the pole or the rod of a display frame or an advertising banner to insert in the center hole of the elongate cylinder stably.

2 Claims, 6 Drawing Sheets

DISPLAY FRAME FIXING DEVICE

BACKGROUND OF THE INVENTION

1. Field of the Invention

This invention relates to a display frame fixing device, particularly to one locked in the ground so as to stabilize a display frame or an advertising banner for preventing the display frame or the advertising banners from blown down by a gust of wind or a large shock, without need of frequently moving a display frame or an advertising banner in and out.

2. Description of the Prior Art

A known conventional fixing device for a display frame or an advertising banner shown in FIG. 1, includes a base 1, a fixing cylinder 10 mounted on the base 1 for a lower end of the pole or the rod of a display frame or an advertising banner to fit tightly therein. Then the weight of the base 1 and the fixing cylinder 10 can keep the pole or the rod of the display frame or the advertising banner stand up. But a display frame or an advertising banner may be blown down in case of a gust of wind, with the base 1 possible to be damaged. Further, those conventional fixing devices may be often stolen, as it is easy to be carried off. In addition, they have to be moved in and out of a store during in business and in rest time, very troublesome.

SUMMARY OF THE INVENTION

The objective of the invention is to offer a fixing device for a display frame or an advertising banner to assemble or disassemble conveniently, possible to prevent a display frame or an advertising banner from blown down by a gust of wind, and not needing frequently moving it in and out.

The feature of the invention is a threaded rod embedded in the ground with its upper end exposing out, a base threadably engaging with the threaded rod and having female threads, an insert member formed in an upper portion of the base and having two abutting inclined surfaces, a fixing cylinder fitting around the base and having a center hole, two openings formed in a lower end, two opposite notches respectively bored with a lateral small hole leading to each opening, two insert blocks pivotally inserted respectively in the two openings and having a lateral hole respectively and two abutting inclined surfaces on an inner side, an elongate cylinder combined on the fixing cylinder, and a sleeve fitting movably around the elongate cylinder having a lower end engaging with the fixing cylinder. Then the sleeve is rotated to move down to surround the fixing cylinder, the fixing device is stably assembled for the pole or the rod of a display frame or an advertising banner to be inserted in the center hole of the elongate cylinder.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
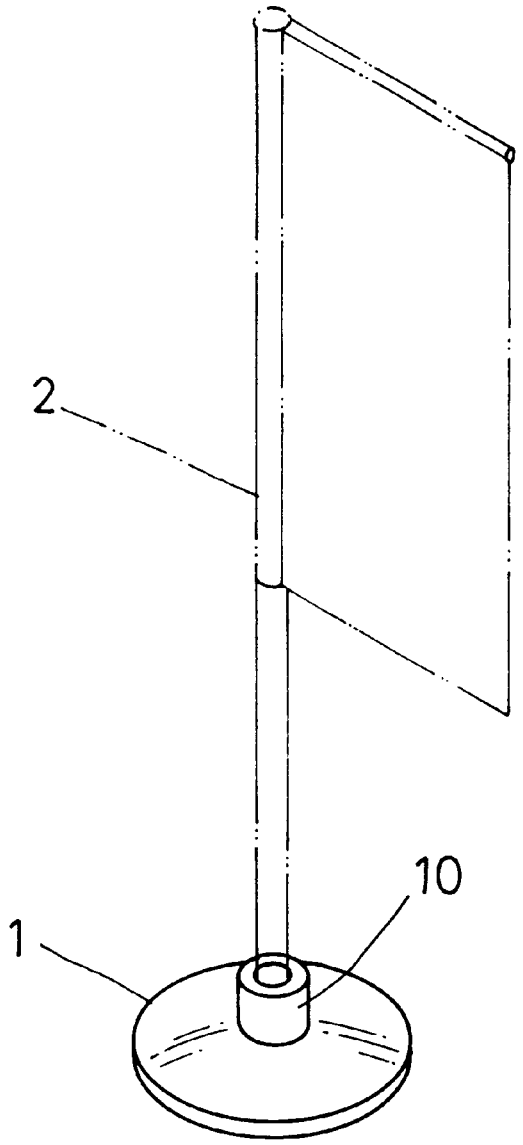
FIG. 1 (PRIOR ART)
FIG. 1 is a perspective view of a known conventional fixing device for an advertising banner.
Figure 2:
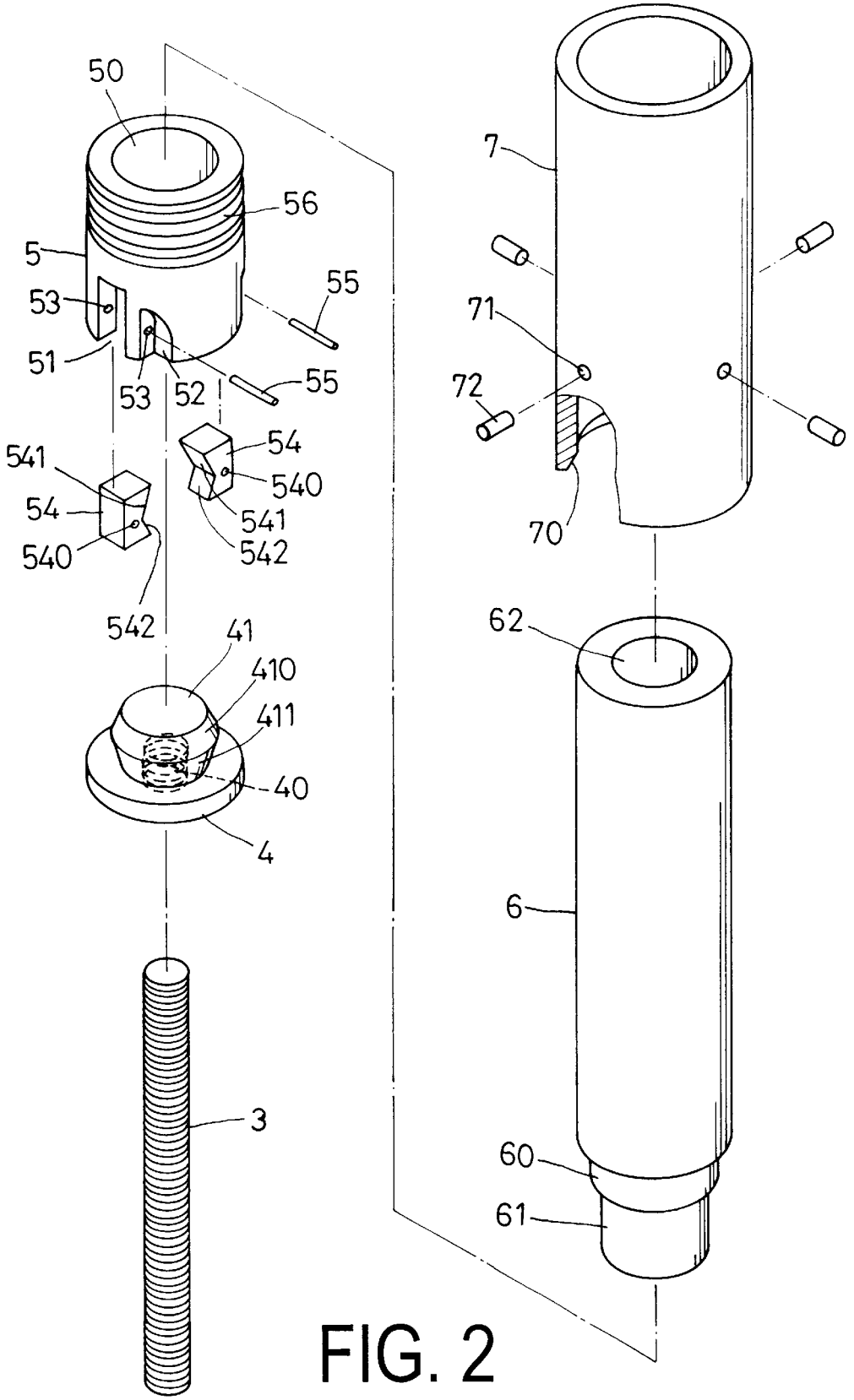
FIG. 2 is an exploded perspective view of a display-frame icing device in present invention.

A preferred embodiment of a display frame fixing device in the present invention, as shown in FIG. 2, includes an elongate threaded rod 3, a base 4, a fixing cylinder 5, an elongate cylinder 6 and a sleeve 7 as main components combined together.

The elongate threaded rod is embedded in the ground, having its outer end exposing out of the ground.

The base 4 has female threads 40 in the bottom center to engage an upper end of the elongate threaded rod 3, an insert member 41 formed in an upper portion and having two annular inclined surfaces 410, 411 abutting on each other and inclined in opposite directions.

The fixing cylinder 5 has a center hole 50 to fit around the base 4, and two vertical opposite openings 51 formed in a lower end wall, a notch 52 formed respectively near each opening 51 and having a lateral small hole 53 to communicate with each opening 51, two insert blocks 54 fitting respectively in each opening 51 and having a lateral hole 540 respectively and two sloped surfaces 541, 542 abutting vertically and sloping down to each other, and a pin 55 fitting in each hole 540 to pivotally combine each insert block 54 with the fix cylinder 5 in each opening 51. Further, the fixing cylinder 5 has male threads 56 formed in an upper end portion.

The elongate cylinder 6 is combined on the fixing cylinder 5, having a smaller-diameter section 60 in a lower portion, a smallest-diameter insert section 61 formed in the end under the smaller-diameter section 60, and a center hole 62 for the pole or the rod of a display frame or an advertising banner to fit therein.

The sleeve 7 has an inner sloped surface formed on an inner wall of a lower end, a plurality of lateral holes 71 spaced apart in an intermediate portion for pins 72 to fit therein and also in a center hole, which fits movably around the elongate cylinder 6.

Figure 3:
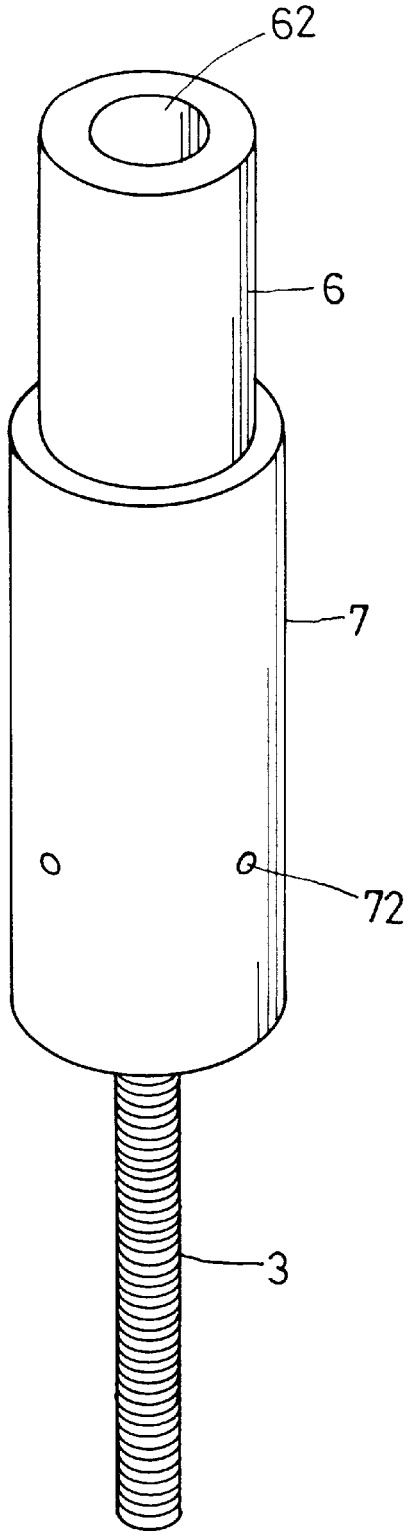
FIG. 3 is a perspective view of the display-frame fixing device in the present invention.
Figure 4:
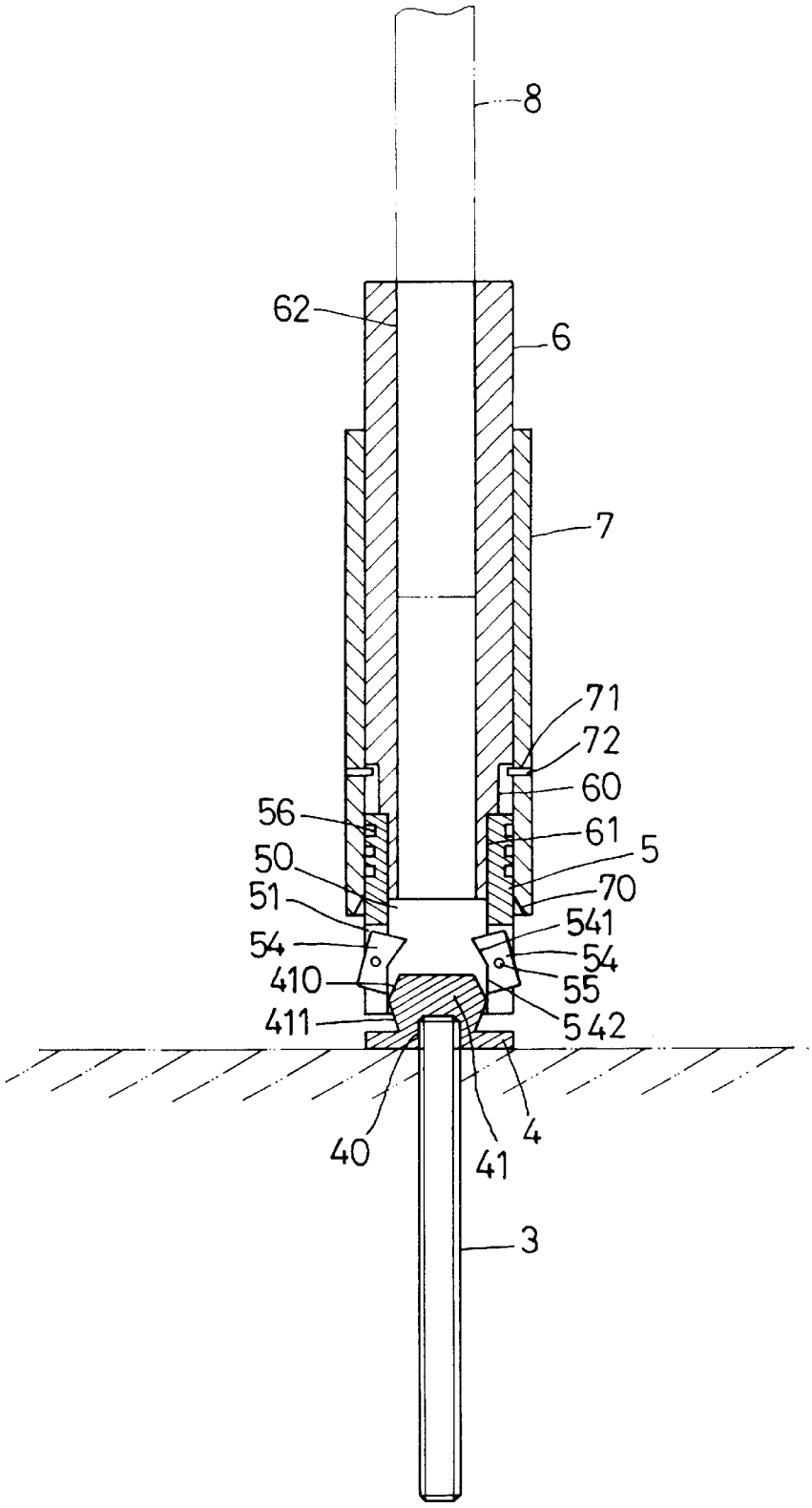
FIG. 4 a cross-sectional view of the display-frame fixing device in the unlocked condition in the present invention.

In assembling, referring to FIGS. 2, 3 and 4, firstly the threaded rod 3 is screwed with the base 4, with pins 55 inserted in the holes 53 of the notches 52, and then in the holes 540 of the insert blocks 54 inserted in the openings 51 so as to pivotally connect the insert blocks 54 with the fixing cylinder 5. Next, fix firmly the insert section 61 of the elongate cylinder 6 in the center hole 50 of the fixing cylinder 5. Then fit the sleeve 7 around the elongate cylinder 6 and move it down to let its lower end located near the two openings 51 of the fixing cylinder 5, and insert the pins 72 in the holes 71 and just under the upper annular edge of the smaller-diameter section 60. Then the lower end of the fixing cylinder 5 is mounted around the base 5, with the two insert blocks 54 fitting with the insert member 41 of the base 4. Then the display-frame fixing device is finished in assembling.

Figure 5:
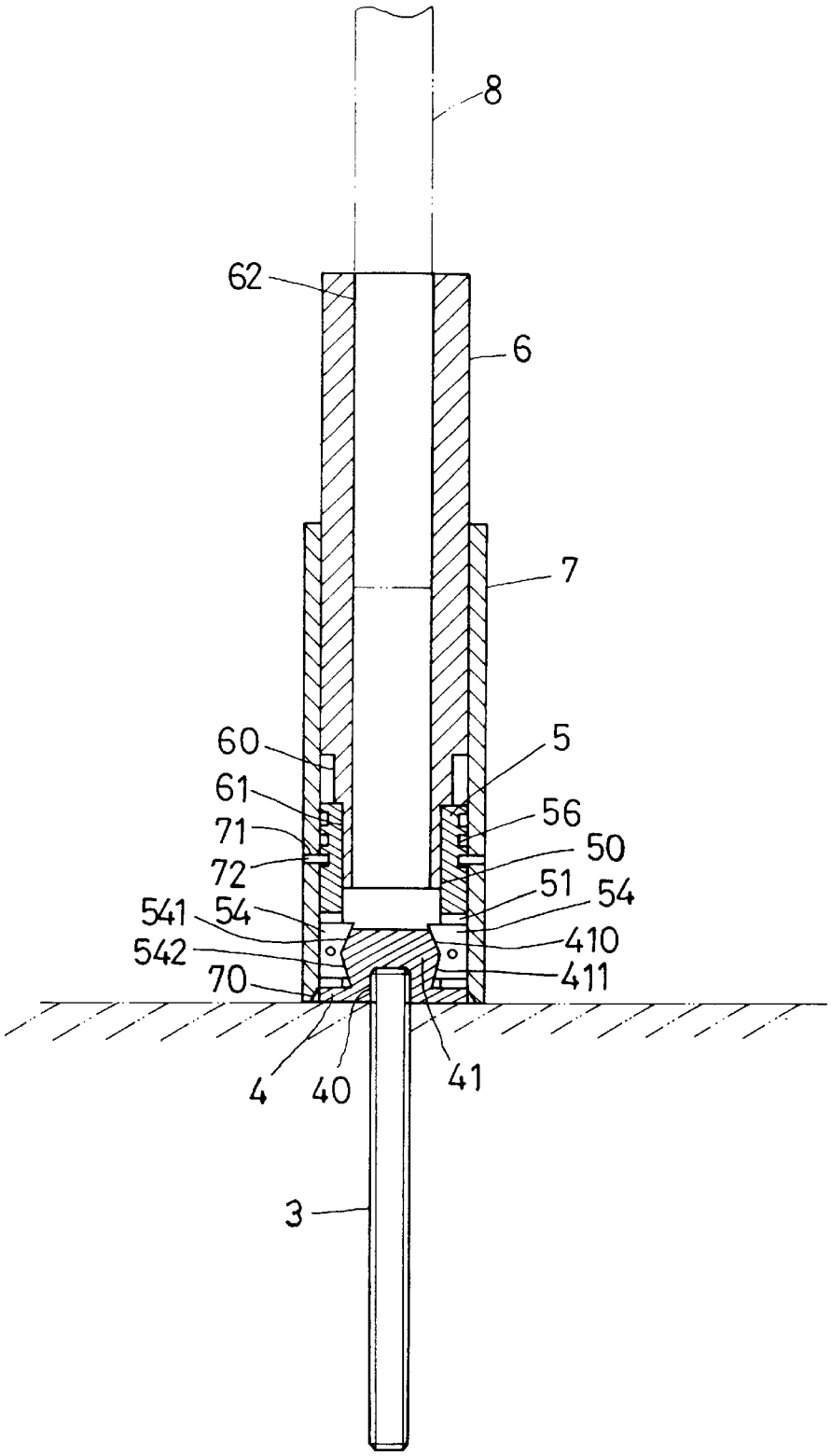
FIG. 5 cross-sectional view of the display-frame fixing device in the lock condition in the present invention; and, FIG. 6 is a perspective view of another embodiment of a display-frame fixing device in the present invention.
Figure 6:
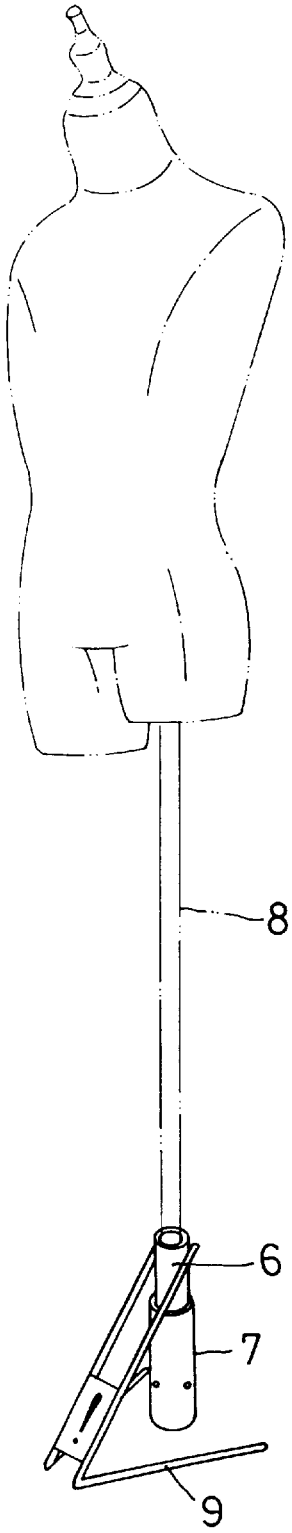

In using, referring to FIGS. 4, 5 and 6, at first, plant the threaded rod 3 in the ground, letting its upper end exposing out, then screw the female threads 40 of the base with the upper end of the threaded rod 3, letting the base 4 rest on the ground. Then the fixing cylinder 5 combined with the elongate cylinder 6 and the sleeve 7 together are assembled with the base 4 by temporarily moving up the sleeve 7, permitting the insert blocks 54 extend outward not pushed by the sleeve. Then rotate the fixing cylinder.5 to let the two inclined surfaces 541, 542 contact with the two sloped surfaces 410, 411. Then rotate the sleeve 7 down against the elongate cylinder 6 to the level of the ground to completely surrounding the fixing cylinder 5, with the pins 72 moving around along the male threads 56 of the fixing cylinder 5 to combine the sleeve 7 tightly with the fixing cylinder 5, with the insert blocks 54 pushed inward by the sleeve 7 to fit with the insert member 41. Then the fixing device is ready for use, and the pole or the rod of a display frame or an advertising banner 8 can be inserted in the center hole 62 of the elongate cylinder 6, as shown in FIG. 6.

If the fixing device is to be taken off, only rotate reversely the sleeve 7 to move up and separate from the lower portion of the fixing cylinder 5, letting the insert blocks 54 extend outward and contact no longer with the insert member 41. Then the fixing cylinder, the elongate cylinder and the sleeve 7 can all together be pulled up and separated from the base 4 so that the fixing device may be taken off. In this way the fixing device is easily assembled and disassembled as well, possible to be locked in the ground to keep a display frame from blown down by a gust. Further, it does not have to be carried in and out.

Another preferred embodiment of a display-frame fixing device is shown in FIG. 6, including an additional. ←-shaped foot frame 9 welded to the two upper sides of the elongate cylinder 6 of the original embodiment for keeping more stably a display frame.

While the preferred embodiments of the invention have been described above, it will be recognized and understood that various modifications may be made therein and the appended claims are intended to cover all such modifications that may fall within the spirit and the scope of the invention.

What is claimed is:

1. A display frame fixing device comprising:

an elongate threaded rod embedded in the ground and having a little upper section exposing out of the ground;

a base having female threads in a center bottom, an insert member formed in an upper portion, said female threads engaging with said little upper section of said elongate threaded rod, said insert member having two annular inclined surfaces abutting on each other;

a fixing cylinder having a center hole to fit around said base, two openings formed in an annular wall of a lower end, a notch formed near each said opening and having a lateral small hole communicating with each said opening, an insert block fitted in each said opening having a lateral small hole and two sloped surfaces formed to abut on each other vertically in an inner side, a pin inserting in said each lateral hole of each said notch and also in said lateral hole of each said insert block so as to pivotally connect each said insert block in each said opening, and male threads formed in an outer surface of the end;

an elongate cylinder having a center through hole, a smaller diameter section formed in a lower portion and a smallest diameter end section fitting in said center hole of said fixing cylinder, said center through hole used for inserting a pole or a bar of a display frame; and, a sleeve movably fitting around said elongate cylinder and having female threads in a lower end to engage with said upper male threads of said fixing cylinder, an annular sloped surface formed in an inner wall of a lower end, and a plurality of lateral pin-holes formed spaced apart in a lower portion for pins to fit therein.

2. The display frame fixing device as claimed in claim 1, wherein a foot frame is additionally welded at two sides of an upper end of said fixing cylinder for keeping more stably said fixing device.

* * * * *